US008622393B2

(12) United States Patent
Hacker et al.

(10) Patent No.: US 8,622,393 B2
(45) Date of Patent: Jan. 7, 2014

(54) TRADING CARD GAME INCLUDING TRADING CARD HAVING A SELECTIVELY UNEXPOSED SECTION

(75) Inventors: Brian J. Hacker, San Diego, CA (US); Wayne R. Wilcoxen, Carlsbad, CA (US); David S. Smith, San Diego, CA (US)

(73) Assignee: The Upper Deck Company, Carlsbad, CA (US)

( * ) Notice: Subject to any disclaimer, the term of this patent is extended or adjusted under 35 U.S.C. 154(b) by 1690 days.

(21) Appl. No.: 11/042,857

(22) Filed: Jan. 25, 2005

(65) Prior Publication Data

US 2006/0163815 A1 Jul. 27, 2006

(51) Int. Cl.
*A63F 1/02* (2006.01)

(52) U.S. Cl.
USPC ..... 273/293

(58) Field of Classification Search
USPC ..... 273/293, 308, 244.2, 255, 243, 306
See application file for complete search history.

(56) References Cited

U.S. PATENT DOCUMENTS

| | | | | |
|---|---|---|---|---|
| 3,767,199 | A | 10/1973 | Board | |
| 4,202,546 | A * | 5/1980 | Bromberg | 273/244.2 |
| 4,398,708 | A | 8/1983 | Goldman et al. | |
| 5,282,651 | A | 2/1994 | Alonso | |
| 5,287,641 | A | 2/1994 | Showers | |
| 5,318,306 | A * | 6/1994 | Levin | 273/293 |
| 5,834,127 | A * | 11/1998 | Baerenwald et al. | 428/595 |
| 6,058,640 | A * | 5/2000 | Young | 40/709 |
| 6,305,687 | B1 | 10/2001 | Pollock et al. | |
| 6,412,779 | B1 * | 7/2002 | Kenney | 273/292 |
| 6,601,851 | B1 * | 8/2003 | Sakamoto et al. | 273/308 |
| 7,144,013 | B2 * | 12/2006 | Tanaka | 273/308 |
| 8,215,641 | B2 * | 7/2012 | Hacker et al. | 273/292 |
| 2004/0036220 | A1 * | 2/2004 | Tanaka | 273/292 |

* cited by examiner

*Primary Examiner* — Gene Kim
*Assistant Examiner* — Alyssa Hylinski
(74) *Attorney, Agent, or Firm* — Roeder & Broder LLP

(57) ABSTRACT

A trading card game (10) includes a first card (212) having only one immovable section (234). The game (10) also includes a second card (314) including a first section (352) and a second section (354). The second section (354) can be slidable relative to the first section (352) so that the second card (314) moves between a first position and a second position. In the first position, a portion of the second section (354) is unexposed to the players. In the second position, the portion of the second section (354) is exposed to the players, and influences the outcome of at least a portion of the game (10).

30 Claims, 6 Drawing Sheets

TRADING CARD GAME INCLUDING TRADING CARD HAVING A SELECTIVELY UNEXPOSED SECTION

BACKGROUND

Playing card games have been popular for many years. However, with the advent of computer games, the more hands-on nature of classic playing card games appears to have taken a backseat. Many of today's computer games do not require an opponent, allowing individuals to play alone with no personal interaction, one-on-one or group competition. Further, many of the old style playing card games are necessarily restricted by the inherent limitations of the standard playing card deck which can lack sophistication, creativity, diversity, complexity and an element of timing. As a consequence, individuals are not typically motivated to collect or trade cards from the standard deck of playing cards, and are therefore less likely to use such standard decks. Thus, an increasing number of individuals appear to be gravitating toward somewhat more anti-social, less hands-on, computer games.

SUMMARY

The present invention is directed toward a trading card game for a first player and a second player. The game includes one or more first cards that each has only one immovable section. The game also includes a second card for each player that includes a first section and a second section. The second section can be movable relative to the first section so that the second card moves between a first position and a second position. In the first position, a portion of the second section is unexposed to the players. In the second position, the portion of the second section is exposed to the players, and influences the outcome of at least a portion of the game. In one embodiment, the second section has a first side and an opposing second side. The first side includes a first indicia and the second side includes a second indicia, with each indicia influencing the outcome of at least a portion of the game, depending upon which side is visible to the players.

In another embodiment, the second card includes a third section that is slidable relative to the first section. The third section moves relative to the first section and the second section. The third section also can influence the outcome of at least a portion of the game. In one embodiment, the unexposed indicia on the second section and/or the third section is known to one of the players before the indicia is exposed, e.g., before the game commences.

In still another embodiment, the second card includes a first surface, a second surface and a third surface. The third surface moves relative to the first and second surfaces between (i) a first position wherein a portion of the third surface is substantially unexposed to the players, and (ii) a second position wherein the portion of the third surface is exposed to the players. In this embodiment, the surfaces remain substantially parallel to one another when the third surface is in the first and second positions. Additionally, the third surface includes an indicia that influences the outcome of at least a portion of the trading card game.

The present invention is also directed toward a method for playing a trading card game between a first player and a second player.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
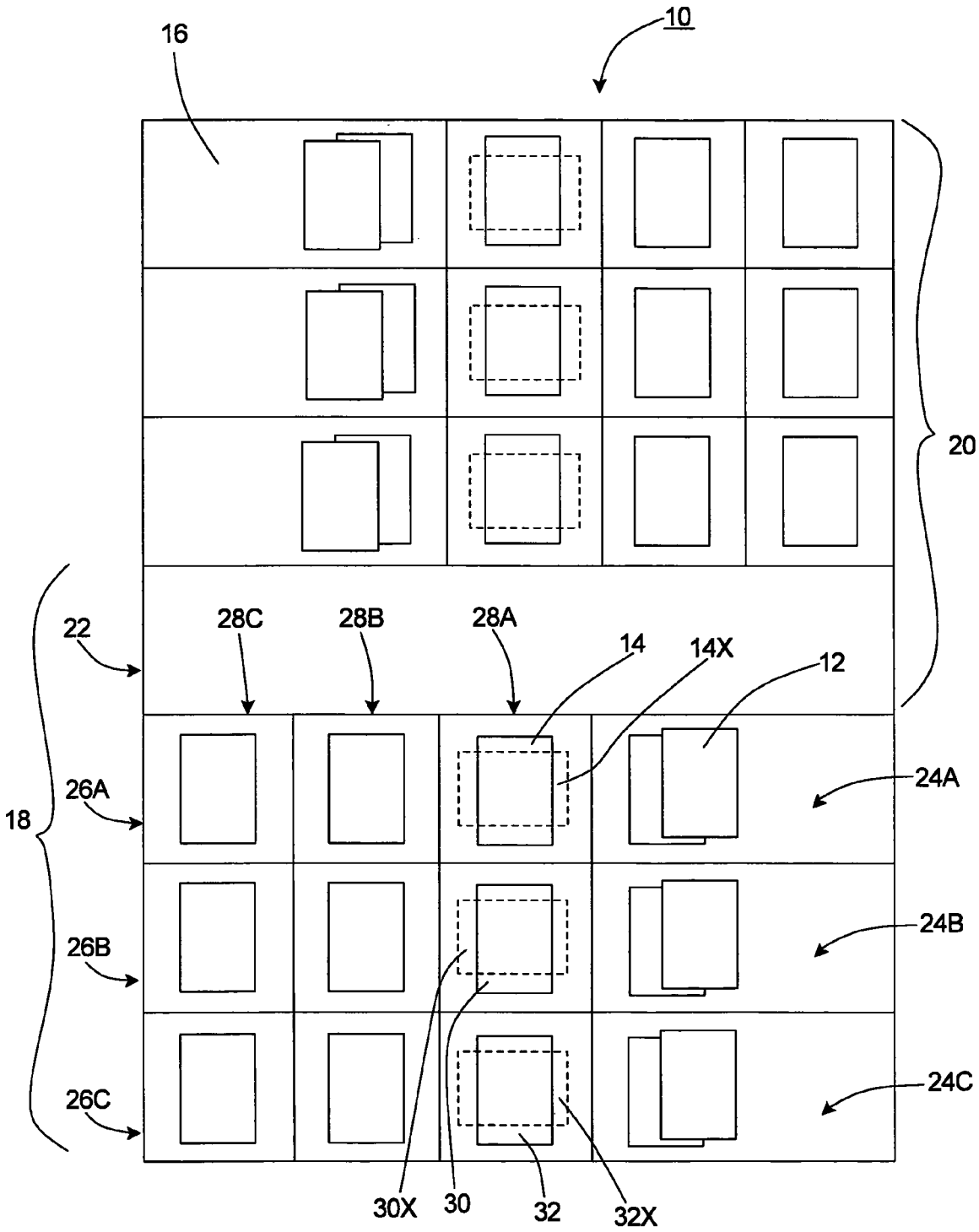
FIG. 1 is a perspective view of an embodiment of a trading card game having features of the present invention including a first card and a second card, the second card being illustrated in a first position.

Referring to FIG. 1 as an overview, the present invention is directed toward a trading card game 10 (also referred to herein simply as "game") that can be played by two or more players (not shown). The rules and visual appearance of the game can vary. However, the embodiments of the game provided herein each includes at least two structurally different types of trading cards (sometimes referred to herein simply as "cards") including one or more first cards 12 and one or more second cards 14. In the embodiment illustrated in FIG. 1, the game 10 also includes one or more play mats 16 upon which the cards 12, 14 are placed during play.

In the description which follows, at least one embodiment of a set of rules for the game 10 is provided. It should be recognized, however, that the rules herein provide one or more representations of literally countless possible sets of rules that can be used without deviating from the spirit and scope of the present invention. The rules to be followed for the game 10 can be decided by the players, or other versions of the rules can be used. Additionally, various indicia that can be included on one or more of the cards 12, 14 in the game 10 are provided herein. However, each of the cards 12, 14 does not need to include all, or even some of the indicia described. Moreover, the description of the indicia and their respective effects on the game 10 is not intended to exclude additional possible indicia and their consequential effects. Stated another way, any inclusion or omission of a discussion regarding certain potential indicia that can be included on the cards 12, 14 is not intended to mandate or limit the scope of such indicia, or the types of possible effects on the outcome of part or all of the game 10.

In embodiments that use the play mat 16, various predetermined positions can be included on the play mat 16 to assist the players. For more advanced players, a play mat 16 may not be necessary. In the embodiment illustrated in FIG. 1, the game includes a first player region 18 and a second player region 20. A portion of the regions 18, 20 can overlap. In one embodiment, the overlapped area is referred to as an advantage region 22. One embodiment of a layout of the game mat 16 will now be described with respect to the first player, recognizing that the layout of the game mat 16 is substantially similar from the perspective of the second player.

The first player region 18 can include a plurality of zones. For example, in this embodiment, the first player region 18 includes a first zone 24A, a second zone 24B and a third zone 24C, although any number of zones can be included in the present invention. The zones 24A-C can be designated by different colors, numerical values, geometric shapes or any other suitable designation. Each zone 24A-C can be energized to varying degrees depending upon the number of cards 12, 14 positioned within each zone 24A-C. In one embodiment, the greater number of cards 12, 14 within a particular zone 24A-C, the higher the energy of that zone 24A-C. For example, at the outset of the game 10, two first cards 12 can be placed in each zone 24A-C, but this total typically changes as the game 10 progresses. Whenever energy is added, a first card 12 is placed facedown in the appropriate zone 24A-C.

The first zone 24A is a player's first line of defense, followed by the second zone 24B and the third zone 24C. The zones 24A-C can be positioned in any order on the play mat 16. In one embodiment, if a player fails to defend in the third zone 24C, the opponent player can score a point, as provided in detail below. The first player to score a predetermined number of points wins the game.

In one embodiment, each player uses a plurality of first cards 12 and only one second card 14. Alternatively, greater than one second card 12 can be used by each player. The first player region 18 can include a plurality of substantially horizontal rows and a plurality of substantially vertical columns. The number of rows and/or columns can vary. For example, in the embodiment illustrated in FIG. 1, the first player region 18 includes a top row 26A, a middle row 26B and a bottom row 26C. Further, in the embodiment illustrated in FIG. 1, the first player region 18 includes a first column 28A, a second column 28B and a third column 28C in addition to the zones 24A-C described above.

The second card 14 can be positioned in the top row 26A of the first column 28A as illustrated in FIG. 1, while the remaining cards can be first cards 12 that are positioned in various other locations throughout the first player region 18. In the embodiment illustrated in FIG. 1, a deck 30 of first cards 12 used by the first player can be positioned in the middle row 26B in the first column 28A. Additionally, a discard pile 32 can be positioned in the bottom row 26C of the first column 28A. However, it is recognized that the positioning of the cards 12, 14 shown in FIG. 1 can be varied.

Moreover, the orientation of the cards 12, 14 in each row 26A-C of the first column 28A can be altered in order to "charge" the row 26A-C. In one embodiment, the rows 26A-C are charged when the cards in the first column 28A are turned approximately 90 degrees, as shown in phantom in FIG. 1. For example, the first row 26A becomes charged when the second card 14 is turned sideways 14X. The second row 26B becomes charged when the deck 30 is turned sideways 30X, and the third row 26C becomes charged when the discard pile 32 is turned sideways 32X. In one embodiment, once the three rows 26A-C are charged, the second card 14 can be used by the player, as described in greater detail below.

The second column 28B and the third column 28C can be used during the course of the game 10 when the player turns over cards one-at-a-time from that player's deck 30, as explained herein. For ease of discussion, a portion of the description of the Figures below may refer back to the overall game 10 illustrated in FIG. 1.

Figure 2:
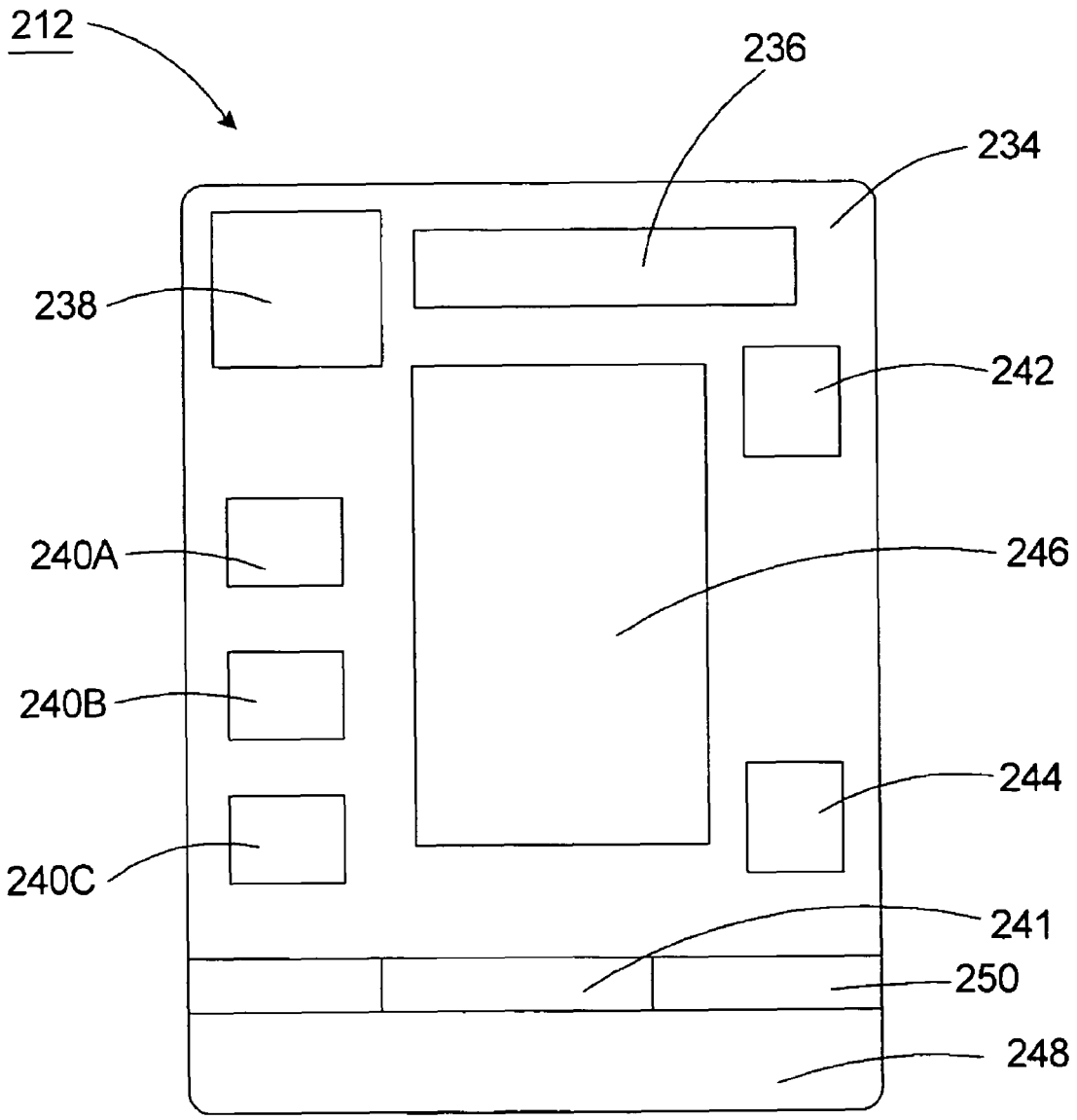
FIG. 2 is a top view of one embodiment of the first card.

FIG. 2 is a top view of one embodiment of the first card 212. In this embodiment, the first card 212 includes only a substantially flat, non-movable section 234. Thus, in this embodiment, the first card 212 is constructed to form a single piece of card material, and therefore, does not move relative to itself. Stated another way, the first card 212 has no moving sections. In this embodiment, the first card 212 can have a similar size and/or form factor to a standard playing card such as that found in a standard 52-card deck. Alternatively, the first card 212 can have dimensions that are greater or smaller than the form factor of a standard playing card.

As non-exclusive examples, each first card 212 can include one or more indicia, such as a card name 236, a trait requirement 238, one or more energy costs 240A-C, a card type 241, an intercept value 242, a force value 244, graphics or other aesthetic images 246, rules text 248, and/or a card version 250. Each first card 212 can be unique, or a player may have more than one first card 212 with the same name 236 in play at a time.

The card namer 236 can be a descriptive name or some other suitable designation. The trait requirement 238 can be a symbol, a number, or any other type of suitable image. The trait requirement 238 can be used by a player during construction of that player's deck. For example, in one embodiment, in order to use one of the first cards 212 having a specific trait requirement 238, there must be a similar trait requirement symbol on one or more of the second cards 14 (illustrated in FIG. 1) also used by that player. Therefore, from a strategic standpoint, the player can construct a deck 30 having first cards 212 with trait requirements 238 that match the trait requirement 238 of the second card 14 used by that player.

The energy costs 240A-C represent the amount of energy that must be spent by the player to use a particular first card 212. The number of different energy costs 240A-C can vary depending upon a number of zones 24A-C (illustrated in FIG. 7) being used in the game 10. For example, if the game 10 includes three zones 24A-C, each first card 212 can potentially include up to three energy costs 240A-C that must be paid by the player in order to use the first card 212. Each energy cost 240A-C can be represented by a number or other graphic that is associated with each zone 24A-C. In one embodiment, for instance, if a first card 212 costs one energy for the first zone 24A, one first card 212 is removed from the first zone 24A, and is placed face-up in that player's discard pile 32.

As an example, a particular first card 212 may have an energy cost 240A of one card in the first zone 24A and a further energy cost 240C of one first card 212 in the third zone 24C. The player wishing to play this strike would therefore take one first card 212 from the first zone 24A, and one first card 212 from the third zone 24C, and put them face-up in that player's discard pile 32.

In one embodiment, an energy cost 240A from the first zone 24A can also be paid with a first card 212 from either the second zone 24B or the third zone 24C. Further, any energy cost 240B from the second zone 24B can also be paid with a first card 212 from the third zone 24C.

The card type 241 indicates the type of first card 212. The card type 241 can provide the type of card using text or some other suitable means. The types of first cards 212 that can be included in the trading card game 10 can vary. In one embodiment, the inclusion or exclusion of certain indicia can distinguish one first card 212 from another first card 212. Further, as non-exclusive examples, the first card 212 can be a strike card, a teamwork card or an advantage card, as explained in greater detail below. Each of these types of first cards 212 can perform different functions during the course of the game 10.

The strike card allows players to take turns attacking the opponent player while simultaneously defending against the opponent player's attacks. As an overview, in one embodiment of the rules of the game 10, the objective is to score a predetermined number of strikes against the opponent player. For example, in one such embodiment, the objective is to score three strikes against the opponent player. However, the number of strikes required to win the game 10 can be varied.

If a player fails to stop a strike in each of that player's zones 24A-C, the opposing player scores a point. The first player to gain a predetermined number of points wins the game 10. The method of scoring a strike is provided herein.

Teamwork cards represent friends and allies that assist the player in combat. In one embodiment, teamwork cards can be played by turning the teamwork card face up in the third column 28C. The teamwork card may be played by paying its cost 240A-C. A teamwork card can remain in play until the conclusion of the game 10 unless it is eliminated by the effects of other cards 212, 14. The teamwork card only affects other cards flipped in the row 26A-C in which the teamwork card is located. In one embodiment, only one teamwork card can remain in play in each row 26A-C. When one player scores a point, that player may add an energy card into each of the zones 24A-C in which that player is currently playing a teamwork card.

Advantage cards can be used to enhance a player's strike card, or to alter any other aspect of the game, including adding or eliminating energy, teamwork, or even allow searching through the player's deck 30. The advantage card can be played by paying the cost 240A-C indicated on the card. When played, advantage cards are placed into the advantage area 22 illustrated in FIG. 1. In one embodiment, advantage cards can affect all the cards 12, 14 that are played. Further, in one embodiment, there is no limit to the number of advantage cards that a player can play in a row 26A-C without moving to the next row.

Referring again to FIG. 2, the intercept value 242 represents the ability of the first card 212 to stop a strike by an opponent player. In order to play one of the strike cards, the strike card must have an intercept value 242 that is greater than or equal to the force value 244 of the incoming attack.

The force value 244 is the attack value of the strike card. Once a player counterattacks with a strike card, the opponent player cannot play a strike card unless the intercept value 242 is equal or greater to the force value 244.

The first card 212 can also include a graphics region 246 to provide aesthetics to the first card 212. The graphics region 246 can include animations of a character represented by the first card 212, or any other suitable graphics.

The rules text 248 can provide rules regarding the specific requirements of using the card 212 or the particular effects of using the card 212. For example, any additional information or explanatory data can be included in the rules text 248, which may or may not have an impact on any portion of the game 10.

The version 250 of the card 212 can change the attributes of the card 212 even though the name of the card 212 may be the same as another card. Different versions 250 of cards 212 by the same name can have different requirements for use and/or different effects on the game 10.

Figure 3A:
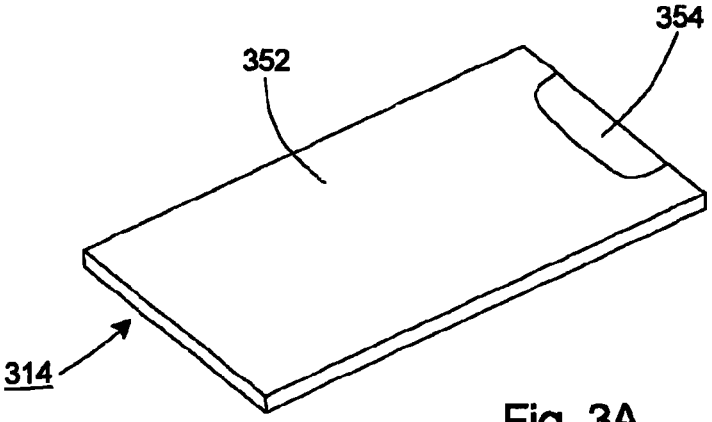
FIG. 3A is a perspective view of an embodiment of the second card illustrated in a first position.

FIG. 3A is a perspective view of the second card 314 shown in a first position. In contrast to the first card 212 (illustrated in FIG. 2), the second card 314 is movable relative to itself. For example, the second card 314 can include a first section 352 and a second section 354 that selectively move relative to one another. It is recognized that either section 352, 354 can be the first section 352 or the second section 354.

Further, in one embodiment, the first section 352 is colored or opaque so that the majority of the second section 354 cannot be seen when the second card 314 is in the first position.

Figure 3B:
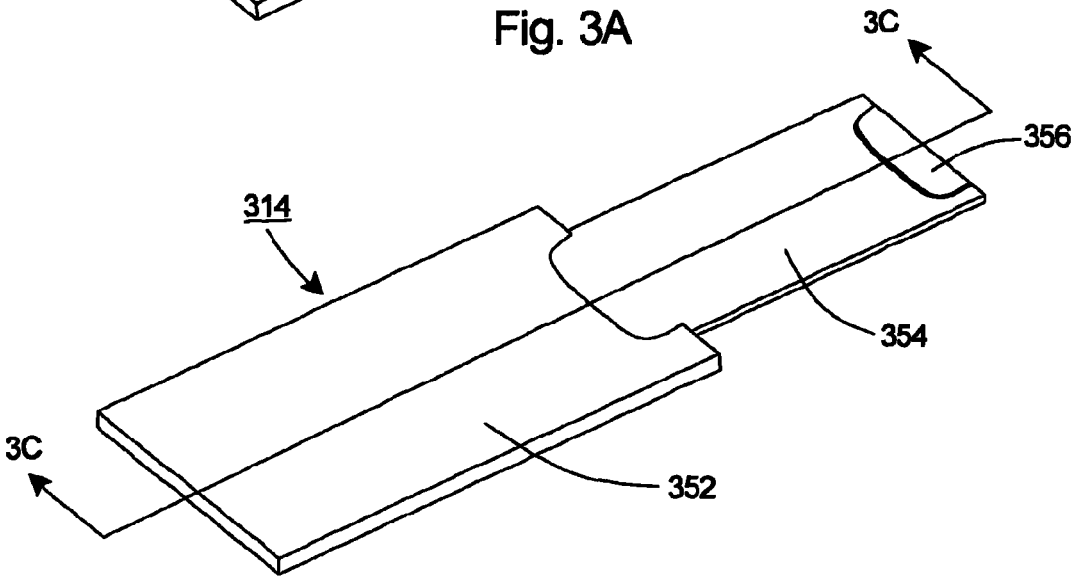
FIG. 3B is a perspective view of the second card illustrated in FIG. 3A in a second position.

FIG. 3B is a perspective view of the second card 314 illustrated in a second position. In the second position, a greater portion of the second section 354 is exposed. In other words, when the second card 314 is in the second position, the players can view a greater portion or all of the second section 354 of the card 314. In this embodiment, the second section 354 is slidingly movable relative to the first section 352. The second section 354 can also include a thickened grip region 356 that the player can use to grip the second section 354 to expose at least a portion of the second section 354 during the game 10. In alternative embodiments, the second section 354 of the second card 314 can be revealed to the players by other means such as unfolding, use of transparent colorless or colored windows, scratch off coverings, etc.

The second card 314 is selectively moved from the first position to the second position by the player that controls the second card 314 at a strategic time during the game 10. In one embodiment, each player knows only what is included on the second section 354 of that player's second card 314. With this knowledge, one player can, under certain circumstances, reveal the second section 354 to the opponent player, and can utilize one or more of the indicia included on the second section 354 as appropriate.

Figure 3C:
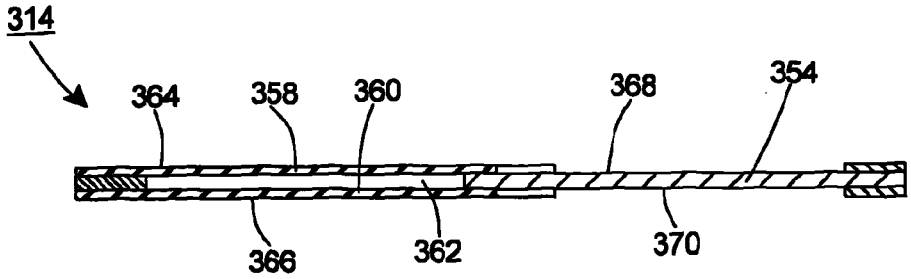
FIG. 3C is a cross-sectional view of the second card taken on line 3C-3C in FIG. 3B.

FIG. 3C is a cross-sectional view of the second card 314 illustrated in FIG. 3B, shown in the second position. In this embodiment, the first section 352 includes a first layer 358 and a spaced apart second layer 360. Between the layers 358, 360 is a gap 362 that houses the second section 354 when the second card 314 is in the first position. The first layer 358 includes a first surface 364 that is exposed to the players. The second layer 360 includes a second surface 366 that is substantially opposite the first surface 364 so that the second surface 366 can also be exposed to the players. Further, in this embodiment, the second section 354 includes a third surface 368 and a substantially opposite-facing fourth surface 370. In this embodiment, all of the surfaces 364, 366, 368, 370 are substantially parallel to one another. Alternatively, not all surfaces 364, 366, 368, 370 are substantially parallel to one another.

Figure 4A:
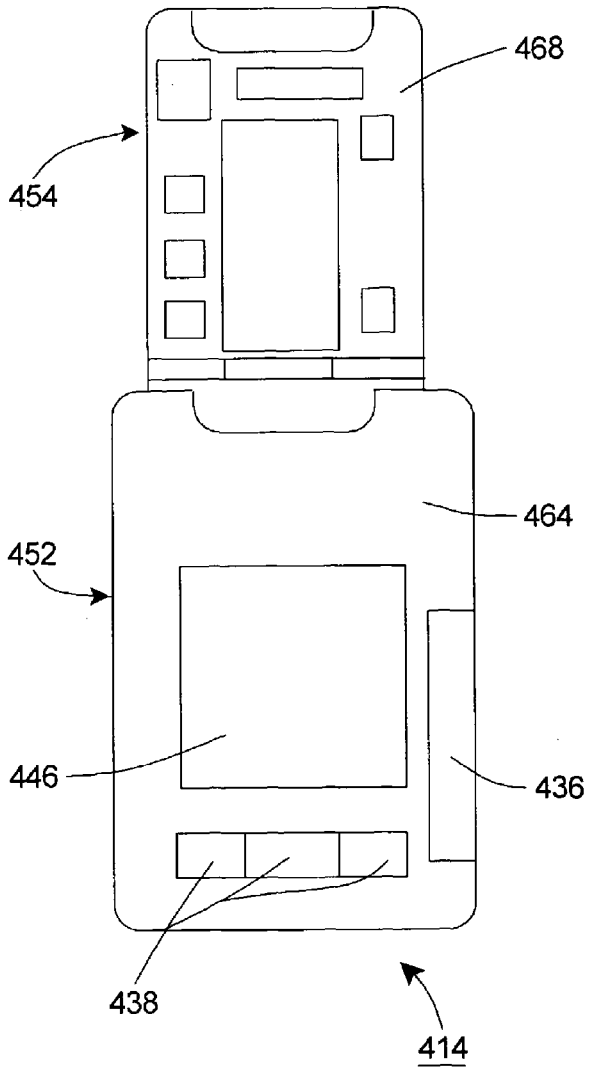
FIG. 4A is a top view of the second card in the second position.

FIG. 4A is a top view of another embodiment of the second card 414 illustrated in the second position so that at least some of the indicia of the second section 454 of the second card 414 are exposed. In this embodiment, the first section 452 can include a first surface 464 having one or more indicia previously described relative to the first card 212 (illustrated in FIG. 2). For example, the first section 452 can include a card name 436, one or more trait requirements 438, and/or graphics or other aesthetic images 446, as non-exclusive examples.

The second section 454 of the second card 414 can also include some or all of the indicia previously described with respect to the first card 212. In one embodiment, the second section 454 includes a third surface 468 which is a scaled down version of a portion of the first card 212, although some of the indicia may have different numerical values, graphics, names, etc. It is recognized that as part of the game 10, the second section 454 can be fully extended, or only partially extended, revealing only some of the indicia of the second section 454.

Figure 4B:
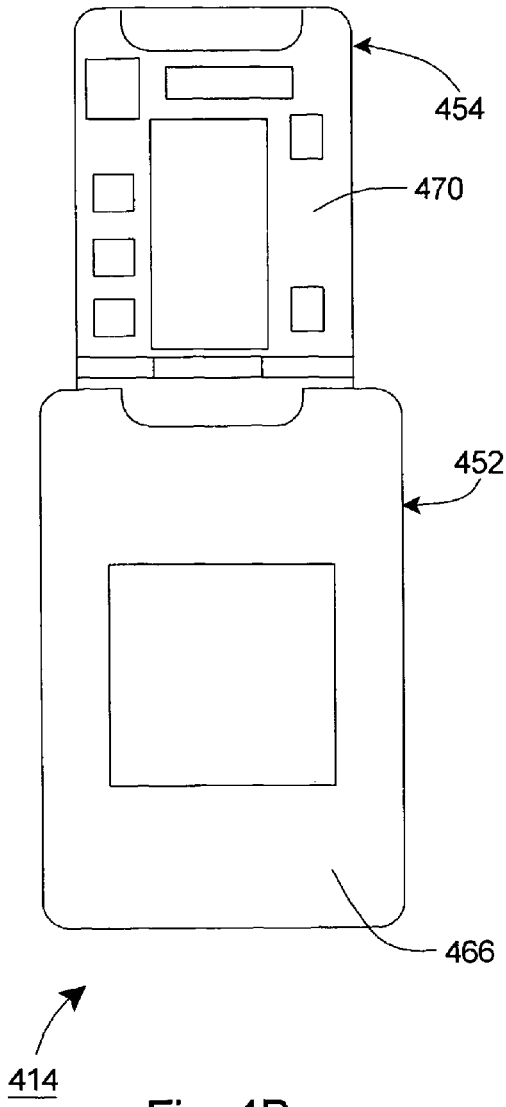
FIG. 4B is a bottom view of the second card in the second position.

FIG. 4B is a bottom view of the second card 414 illustrated in FIG. 4A, shown in the second position. The second card 414 can also have a second surface 466 positioned on the first section 452, and a fourth surface 470 positioned on the second section 454. The second surface 466 and the fourth surface 470 may include one or more indicia previously described relative to the first card 212 (illustrated in FIG. 2).

Figure 5A:
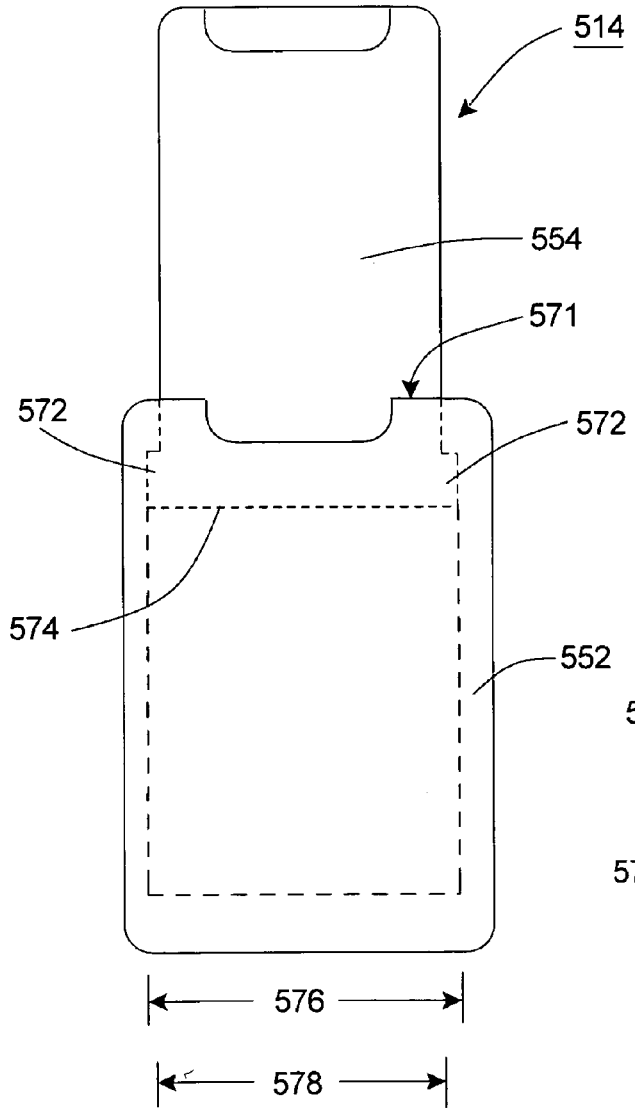
FIG. 5A is a top view of the second card in the second position including portions of the second card illustrated in phantom.

FIG. 5A is a top view of another embodiment of the second card 514 illustrated in the second position, with a portion of the second card 514 in phantom for clarity. In this embodiment, the first section 552 includes an opening 571 through which a portion of the second section 554 slides. Further, the second section 554 includes one or more flanges 572 positioned at or near a bottom edge 574 of the second section 554. The flanges 572 make the second section 554 wider at or near the bottom edge 574 to inhibit the second section 554 from being completely removed from the first section 552. Stated another way, a width 576 of the second section 554 at or near the bottom edge 574 is greater than a width 578 of the opening 571 formed in the first section 552 in which the second section 554 slides. With this design, a particular second section 554 can be permanently associated with a respective first section 552, and the potential for a player losing either the first section 552 or the second section 554 is decreased.

Figure 5B:
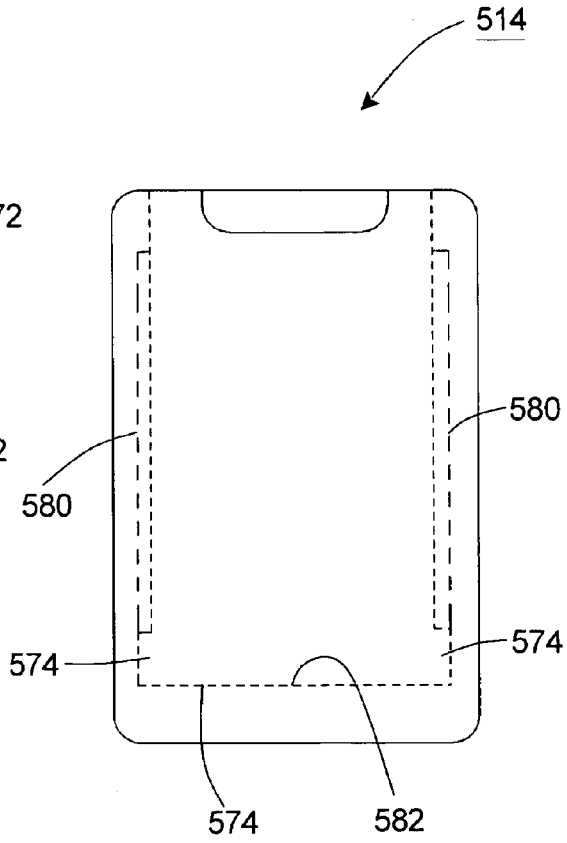
FIG. 5B is a top view of the second card in the first position including portions of the second card illustrated in phantom.

FIG. 5B is a top view of the second card 514 illustrated in FIG. 5A, in the first position. In this embodiment, the first section 552 includes two inside side edges 580 and an inside bottom edge 582. In the first position, the bottom edge 574 of the second section 554 can be in contact with the bottom inside edge 582 of the first section 552. Further, the flanges 574 of the second section 554 can move against one or both of the inside side edges 580 of the first section 552 for greater stability. In alternative embodiments, the first section 552 and the second section 554 can have different configurations.

Figure 6A:
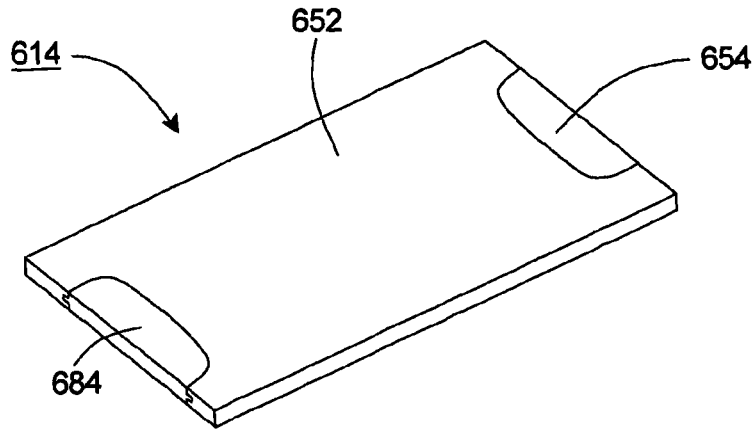
FIG. 6A is a perspective view of another embodiment of the second card in a first position.

FIG. 6A is a perspective view of another embodiment of the second card 614 illustrated in a first position. In this embodiment, the second card 614 includes a first section 652, a second section 654 and a third section 684. In the first position, the majority of the second section 654 and the third section 684 are unexposed from view by the players.

Figure 6B:
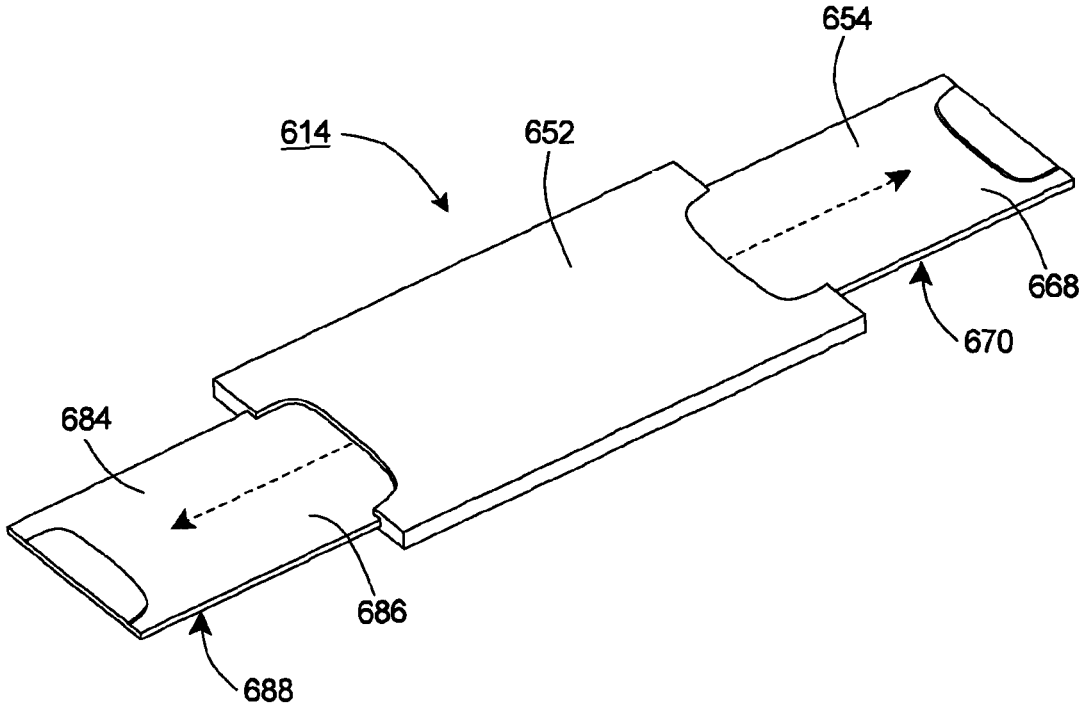
FIG. 6B is a perspective view of the second card illustrated in FIG. 6A in a second position.

FIG. 6B is a perspective view of the second card 614 illustrated in the second position. In the second position, a greater portion of the second section 654 and/or the third section 684 are exposed to the players. It is recognized that the second section 654 and the third section 684 can be simultaneously or alternately exposed when the second card 614 is in the second position.

In the embodiment illustrated in FIG. 6B, the second section 654 can include two opposing surfaces 668, 670, and the third section 684 can include two opposing surfaces 686, 688. Further, in at least some of the embodiments provided herein, the surfaces are substantially parallel to one another.

In this embodiment, either or both of the second section 654 and the third section 684 can have indicia similar to the indicia previous described relative to the first card 212 (illustrated in FIG. 2). Further, in this embodiment, the indicia included on the third section 684 can be complimentary, e.g., additive, to the indicia included on the second section 654. Alternatively, the indicia included on the third section 684 can offset or cancel the indicia included on the second section 654. Still alternatively, the indicia included on the third section 684 can have a different purpose than the indicia included on the second section 654.

Playing the Game

Referring back to FIG. 1, one embodiment of the game 10 will now be described in greater detail. A player's deck 30 can be constructed by the player around that player's favorite second card 14, for example. Rules can be applied to deck construction such as: (1) the deck may have no fewer than 30, or alternatively, 60 cards, (2) the deck may have no more than four copies of any specific card, or (3) the deck can include a plurality of first cards, and only one second card, as non-exclusive examples. In an alternative embodiment, for instance, the deck 30 can include a plurality of second cards 14.

Some cards may have the same card name 222, but actually have different version names 238 and/or different game text 236, for example. In this case, four of each version could be played, since these may actually be different cards having different effects.

Each player can place two first cards 12 face down from their deck 30 without looking at them into the first zone 24A. Each player can then place two cards from the deck 30 face-down in both the second zone 24B and third zone 24C. Each player places the top four first cards 12 from their deck 30 face-up into their discard pile 32. Each player adds up the total force value 244 of the four first cards 12 in their discard pile 32. The player with the highest total force value 244 will decide who defends first. If the players tie, each flips an additional card from their deck 30 into their discard pile 32 until the tie is broken.

Players defend first in the first row 26A, then, if necessary, the second row 26B, and finally, the third row 26C. Cards are flipped face-up into the second column 28B in the row being defended. Once a card is flipped, it can be played by paying its energy cost 240A-C. If the card is not played, the card may be "focused" and be added face down to the energy stack in that row. If this occurs, the player is now defending in the next row down. Because of card effects, sometimes the player will not be able to either play or focus a card. When this happens, the player must instead discard the card into the discard pile 32. The player may voluntarily discard a card instead of playing or focusing it. The player then defends in the next row down.

Whenever a strike is played, it is referred to as a counter-attack. When counterattacks occur with a strike card, the strike card is turned sideways in the second column 28B. This indicates that the player's turn is over. The opponent player must now defend against the force of that strike.

The first action the defending player takes on his or her turn is to cleanup his or her region 18, 20. The defending player removes all of the cards he or she played when last defending and puts them into the discard pile 32. Normally this includes the last strike that he or she played and/or any advantages in his or her advantage area 22. In one embodiment, the energy cards as well as any teamwork cards that are in play are never cleaned up, and remain in play even after someone scores a point.

After cleanup, the defending player now has a chance to replenish his or her energy. Replenishing is one of the main ways in which each player gains energy. The deeper the row from which one player was forced to counterattack, the more energy the other player will gain. In one embodiment, the row from which the opposing player counterattacked is determined, and one energy card is added to the zone for that row and each row above that row.

Before the defending player starts defending in the appropriate row, the defending player has a chance to play his or her second card 14. As indicated above, the player may only play that player's second card 14 if all of that player's rows 26A-C are charged. Playing the advantage card is one method of charging zones. In one embodiment, whenever an advantage card is played, the row in which the advantage card was played can be charged. Charging all three rows 26A-C is the only way to use the second section 354 of the second card 14.

Once charged, a row can stay charged until the second section 354 of the second card 14 is exposed to the opponent and is used to affect the outcome of at least a portion of the game 10. Once all these conditions are met, the second section of the second card can be revealed and played against the opponent player. To do so, the player can uncharge all of that player's charged zones. The second section is then revealed to the opponent player, and the energy cost is paid, if required.

If the player cannot or decides not to play the second card 14, the player begins defending as normal in the first row 26A. The defending player continues defending in each of the three rows 26A-C until that player either counterattacks or is unable to counterattack, in which case the opponent player scores a point. Once one player scores three points, that player is declared the winner. If no one has won after a point is scored, the process is repeated until a winner is determined.

The second card 14 cleans up differently than the first card 12. Regardless of whether the opponent player has succeeded in counterattacking, or whether a point is scored, the second section 354 is again concealed by moving the second section 354 to the first position, and the second card 14 is flipped over so that the second surface 366 is face up.

The next time the player charges up that player's rows, the player will now be able to reveal and play the fourth surface 370 of the second section 354 to reveal the indicia on the fourth surface 370. If the fourth surface 370 of the second section 354 has just been revealed and played, the player can flip the second card 14 back over to show the first surface 364 of the first section 352, and start all over again.

While the particular trading card game 10 as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A method for playing a trading card game between a first player and a second player, the method comprising the steps of:

the first player playing one or more first cards that influence the outcome of at least a portion of the trading card game, each first card being formed as only one section;

the first player providing a second card having a first section and a second section that moves relative to the first section, the second section being movable between a first position wherein the second section is substantially unexposed to the players and a second position, the second section including a first indicia that is known only to the first player while the second section is in the first position;

the first player positioning at least one of the first cards and the second card in a first zone, wherein the first zone is energized to varying degrees depending on the number of cards positioned within the first zone; and the first player moving the second section to the second position to expose the first indicia to the second player to influence the outcome of at least a portion of the trading card game.

2. The method of claim 1 further comprising the step of the first player altering the orientation of one first card relative to the second card, and wherein the step of moving the second section relative to the first section occurs only following the alteration of the orientation of the first card relative to the second card.

3. The method of claim 1 wherein the step of the first player moving the second section includes sliding the second section relative to the first section.

4. The method of claim 3 wherein the step of sliding includes maintaining engagement between the first section and the second section following exposing the first indicia to the second player.

5. A method for playing a trading card game between a first player and a second player, the method comprising the steps of:

the first player playing one or more first cards that influence the outcome of at least a portion of the trading card game, each first card including only a first surface and a second surface that do not move relative to one another;

the first player providing a second card having a first surface, a second surface and a third surface having a first indicia that is known only to the first player while the third surface is unexposed to the players;

the first player positioning at least one of the one or more first cards and the second card in a first zone;

the first player utilizing the first zone as a first line of defense;

the first player positioning at least one of the one or more first cards and the second card in a second zone;

the first player utilizing the second zone as a second line of defense upon failure of the first line of defense; and the first player selectively moving the second card to expose the first indicia to the second player to influence the outcome of at least a portion of the trading card game.

6. The method of claim 5 wherein the step of selectively moving including the surfaces remaining substantially parallel to one another when the third surface is exposed to the second player.

7. The method of claim 5 further comprising the step of the first player altering the orientation of one of the first cards relative to the second card, and wherein the step of moving the second card to expose the third surface occurs only following the alteration of the orientation of the first card relative to the second card.

8. The method of claim 7 wherein the step of the first player moving the second card includes sliding the third surface relative to the first surface.

9. The method of claim 8 wherein the step of sliding includes maintaining contact between the third surface and at least one of the first surface and the second surface during exposing the first indicia to the second player.

10. The method of claim 1 further comprising the step of positioning at least one of the first cards and the second card on a play mat that includes a plurality of substantially horizontal rows that are used by at least one of the players.

11. The method of claim 10 further comprising the step of positioning at least one of the first cards and the second card on a play mat that includes a plurality of substantially vertical columns that are used by at least one of the players.

12. The method of claim 11 wherein the step of the first player moving the second section relative to the first section only occurs after the first player changes the orientation of at least one of the first cards and the second card in each substantially horizontal row on the play mat.

13. The method of claim 1 wherein the step of the first player moving the second section relative to the first section only occurs after the first player changes the orientation of the second card relative to the one or more first cards.

14. The method of claim 13 wherein the step of the first player changing the orientation of the second card relative to the one or more first cards includes rotating the second card by a predetermined angle relative to the one or more first cards.

15. The method of claim 1 wherein the step of the first player providing a second card includes the second section having a second indicia that is known only to the first player while the second section is unexposed to the players.

16. The method of claim 15 wherein the second indicia is positioned on a fourth surface of the second card, and the first indicia is positioned on a third surface of the second card, the fourth surface being substantially opposite the third surface.

17. The method of claim 15 further comprising the step of the first player exposing the second indicia to the second player only occurs after the first player twice changes the orientation of the second card relative to the one or more first cards.

18. The method of claim 5 further comprising the step of positioning at least one of the one or more first cards and the second card on a play mat that includes a plurality of substantially horizontal rows that are used by at least one of the players.

19. The method of claim 18 further comprising the step of positioning at least one of the one or more first cards and the second card on a play mat that includes a plurality of substantially vertical columns that are used by at least one of the players.

20. The method of claim 19 wherein the step of the first player moving the second card to expose the third surface to the second player only occurs after the first player changes the orientation of at least one of the one or more first cards and the second card in each substantially horizontal row on the play mat.

21. The method of claim 5 wherein the step of the first player moving the second card to expose the third surface to the second player only occurs after the first player changes the orientation of the second card relative to the one or more first cards.

22. The method of claim 21 wherein the step of the first player changing the orientation of the second card relative to the one or more first cards includes rotating the second card by a predetermined angle relative to the one or more first cards.

23. The method of claim 5 wherein the step of the first player providing a second card includes the second card having a fourth surface that includes a second indicia that is known only to the first player while the fourth surface is unexposed to the players.

24. The method of claim 23 wherein the fourth surface is substantially opposite the third surface.

25. The method of claim 23 further comprising the step of the first player exposing the second indicia to the second player only occurs after the first player twice changes the orientation of the second card relative to the one or more first cards.

26. The method of claim 1 further comprising the step of the first player positioning at least one of the one or more first cards and the second card in a second zone that is different than the first zone, wherein the second zone is energized to varying degrees depending on the number of cards positioned within the second zone.

27. The method of claim 26 further comprising the step of the first player utilizing the first zone as a first line of defense and utilizing the second zone as a second line of defense.

28. The method of claim 26 further comprising the step of the first player positioning at least one of the one or more first cards and the second card in a third zone that is different than the first zone and the second zone, wherein the third zone is energized to varying degrees depending on the number of cards positioned within the third zone.

29. The method of claim 28 further comprising the step of the first player utilizing the first zone as a first line of defense, utilizing the second zone as a second line of defense, and utilizing the third zone as a third line of defense.

30. The method of claim 5 further comprising the steps of the first player positioning at least one of the one or more first cards and the second card in a third zone that is different than the first zone and the second zone, and the first player utilizing the third zone as a third line of defense.

* * * * *